United States Patent [19]

Kashden

[11] 4,300,741

[45] Nov. 17, 1981

[54] SWINGABLE HANGER SUPPORT MEMBER

[75] Inventor: R. Paul Kashden, Hewlett, N.Y.

[73] Assignee: Closet Systems Corp., Hewlett, N.Y.

[21] Appl. No.: 96,995

[22] Filed: Nov. 23, 1979

Related U.S. Application Data

[63] Continuation-in-part of Ser. No. 951,977, Oct. 16, 1978, Pat. No. 4,209,156.

[51] Int. Cl.[3] ..... E04G 3/00

[52] U.S. Cl. ..... 248/289.1; 211/105.1

[58] Field of Search ..... 248/289.1, 302; 211/96, 211/165, 168, 105.3, 105.2, 105.1; 223/95

[56] References Cited

U.S. PATENT DOCUMENTS

| | | | |
|---|---|---|---|
| 1,359,012 | 11/1920 | Yates et al. | 211/105.3 X |
| 2,194,191 | 3/1940 | Wolf | 223/95 X |
| 2,786,579 | 3/1957 | Wright | 211/96 X |
| 2,825,469 | 3/1958 | Watkins et al. | 211/105.3 |
| 2,926,824 | 3/1960 | St. Clair | 211/96 X |
| 3,294,248 | 12/1966 | Olson | 211/96 |
| 3,561,607 | 2/1971 | Deeley | 211/96 |
| 3,640,494 | 2/1972 | Ruter | 248/289.1 X |
| 3,825,127 | 7/1974 | Morrison | 248/289.1 X |

FOREIGN PATENT DOCUMENTS

| | | | |
|---|---|---|---|
| 207963 | 9/1955 | Australia | 223/95 |

*Primary Examiner*—J. Franklin Foss

*Attorney, Agent, or Firm*—Henry R. Lerner

[57] ABSTRACT

A swingable hanger support member comprises a laterally extending longitudinal member provided at one end thereof with a downturned portion adapted to be received in an aperture for pivotal movement thereabout. The other end of the longitudinal member is provided with a formation which defines with the longitudinal member means which are adapted to wedgingly engage spaced portions of a hook of a conventional hanger so as to releasably support the hanger in a vertical plane substantially coplanar with the vertical plane defined by the longitudinal member and the downturned portion.

4 Claims, 17 Drawing Figures

FIG. 11.
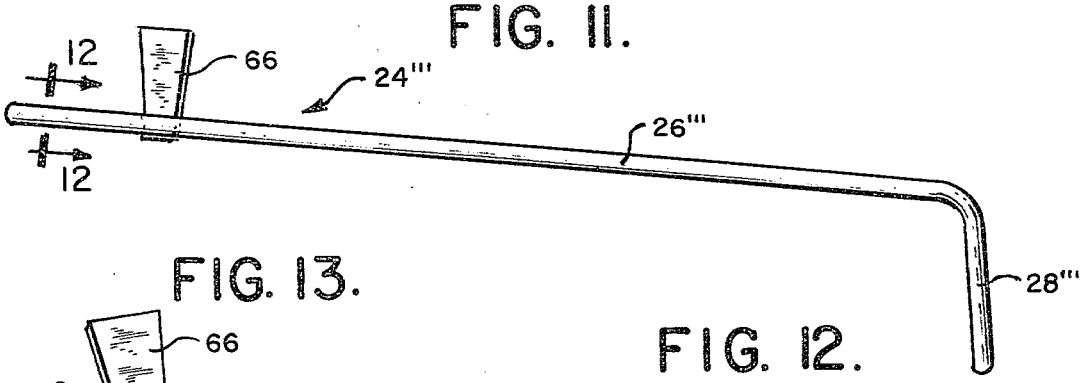
FIG. 13.
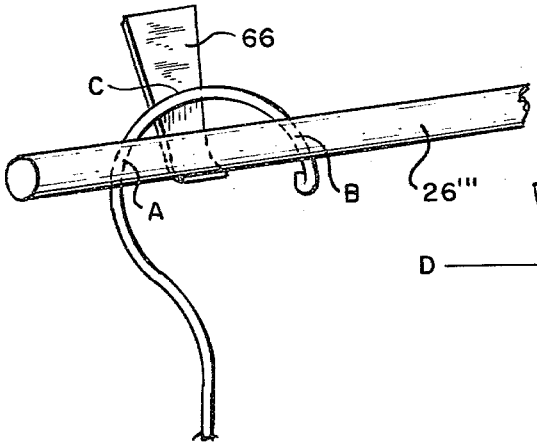
FIG. 12.
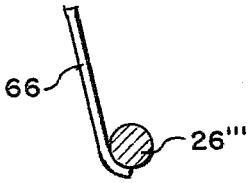
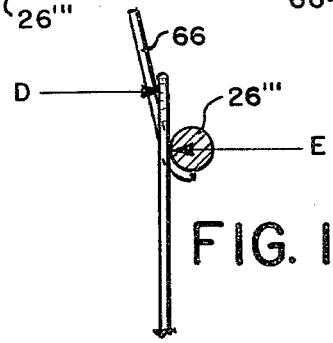
FIG. 14.
FIG. 15.
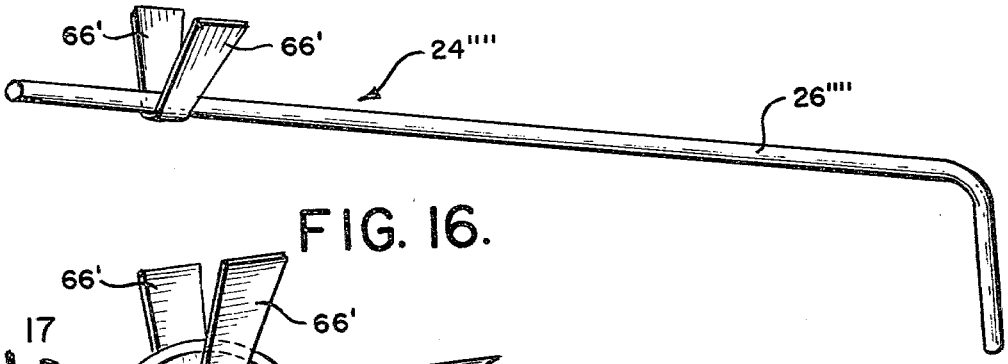
FIG. 16.
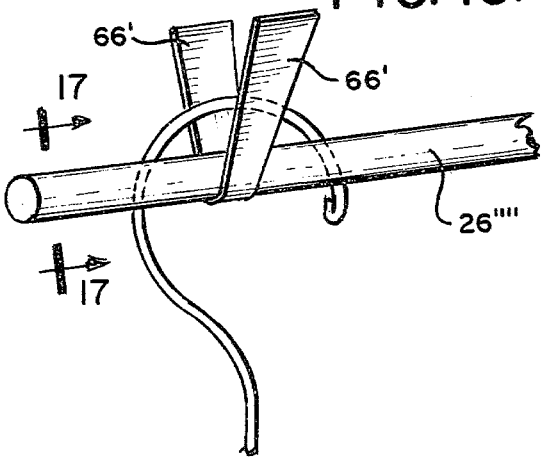
FIG. 17.
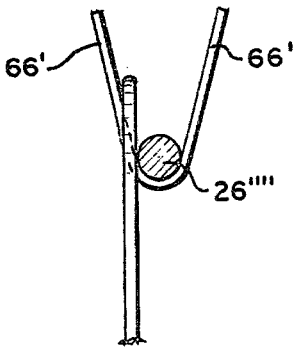

SWINGABLE HANGER SUPPORT MEMBER

RELATED APPLICATION

This is a continuation-in-part of application Ser. No. 951,977 filed Oct. 16, 1978, now U.S. Pat. No. 4,209,156, dated June 24, 1980.

BACKGROUND OF THE INVENTION

Conventionally, clothes closets are provided with one or more longitudinal rods secured at opposite ends thereof to the closet walls for suspending therefrom conventional hangers which support all types of wearing apparel, such as jackets, blouses, pants, skirts, etc. Such an arrangement fails to make efficient use of limited closet space and is often cumbersome to use. More specifically, the suspended clothes tend to be crowded in and tight, one against the other, making it usually inconvenient and difficult either to remove or insert an article of clothing, requiring the user to spread apart the hangers to the left from those to the right of the desired hanger in order to create sufficient room therebetween for the removal or insertion of the hanger in question or the clothes supported thereby. In addition to the inconvenience and difficulty involved, it also has the effect of overcrowding the suspended garments which then become wrinkled.

In order to avoid the above described disadvantages, there have been developed and used improved hanger mechanisms wherein the hanger proper is fixedly secured at one end of a laterally extending rod, the other end of which is provided with a downwardly extending portion adapted to fit in an aperture whereby it is pivotable within such aperture. This arrangement permits the hanger proper to swing about its pivot which is horizontally spaced therefrom. Such arrangement makes far more efficient use of closet space since adjacent pivot apertures can be closely spaced while still not crowding the garments supported by the hangers proper which are laterally spaced from their pivot apertures and which can be easily swung in either direction (as pages of a book are turned) to make any particular hanger easily accessible to either place a garment thereon or remove one therefrom, thus eliminating the problem of removing a particular garment which is crowded between adjacent garments. An example of such improved swingable hanger construction wherein the hanger proper is fixedly secured to one end of a laterally extending rod whose other end is pivotally mounted to a wall mount in the closet is shown in U.S. Pat. No. 3,118,544 and British Patent Specification No. 174,283.

Such swingable hanger construction, though constituting a vast improvement over the conventional hanger supporting rod arrangement in that it makes far better utilization of limited closet space and makes removal and suspension of garments far easier, still presents a number of problems due particularly to the fact that the hanger portion of the assembly is permanently affixed to the laterally extending rod. In view of this, it is impossible, for example, when clothes come back from the cleaners on a hanger, to suspend such hanger directly onto the hanger assembly. Instead the article of clothing must be removed from the hanger provided by the cleaning establishment and must then be rehung onto the hanger proper of the assembly. This is an additional inconvenience especially where the hanger assembly is suspended at an elevated location not easily accessible by the user. Furthermore, the known swingable hanger arrangements make it impossible to use preferred hangers, either for aesthetic or functional reasons. Further still, if for any reason the hanger proper breaks off its assembly, the entire assembly must be replaced.

It is a main object of the invention to provide a swingable hanger assembly which retains all the above pointed out advantages thereof without, however, having the accompanying disadvantages referred to above.

SUMMARY OF THE INVENTION

In accordance with the invention there is provided a hanger support member to which there may be releasably secured any conventional hanger which will then be supported at one end of a lateral rod, the other end of which is pivotally mounted to a wall mount so that such conventional hanger is swingable in either direction for easy access thereto.

The hanger support member consists of a laterally extending wire terminating at one end thereof with a downturned portion intended to be received within an aperture on a wall mount. The other end of the wire is provided with a formation adapted to easily receive the hook of any conventional hanger so as to cause the hanger to automatically be suspended in a vertical plane which for all intents and purposes is coplanar with the vertical plane defined by the laterally and downwardly extending portions of the wire. The formation in question can be a continuation of the wire bent back upon itself to define, with the lateral portion of the wire, a pair of opposite V-shaped openings within which the hook of a conventional hanger is automatically wedged so as to be suspended in a vertical plane.

In accordance with another embodiment, such formation can comprise a separate wire portion welded onto the laterally extending wire so as to define a pair of opposite V-shaped openings which similarly wedge the hook of a conventional hanger so as to suspend the hanger in a vertical plane.

In accordance with yet another embodiment of the invention, there are provided two wire portions welded onto opposite sides of the laterally extending wire to define two pairs of opposite V-shaped openings so as to support a hanger on either or both sides of the wire in a vertical plane or planes.

In accordance with yet another embodiment of the invention there is secured to at least one side of the laterally extending wire a narrow bar extending upwardly and outwardly so as to wedgingly support a hanger between said bar and said laterally extending wire in a vertical plane.

Further in accordance with the invention, the laterally extending wire serves as a guide for the hanger proper so as to facilitate the suspension of the hanger proper on the hanger support member even where the latter is mounted at an elevated location, above eye level, not readily visible or accessible.

BRIEF DESCRIPTION OF THE DRAWINGS

FIG. 11 is a perspective view of yet another embodiment of a swingable hanger support member in accordance with the invention;

FIG. 12 is a view taken along line 12—12 of FIG. 11;

FIG. 13 is a fragmented view of the free end of the hanger support member shown in FIG. 11, on an enlarged scale, showing a hanger supported thereby;

FIG. 14 is a view similar to FIG. 12 and also showing a hanger suspended by the support member;

FIG. 15 is a perspective view of yet another embodiment of a swingable hanger support member in accordance with the invention;

FIG. 16 is a fragmented view of the free end of the hanger support member shown in FIG. 15, on an enlarged scale, showing a hanger supported thereby; and FIG. 17 is a view taken along line 17—17 of FIG. 16.

DESCRIPTION OF THE PREFERRED EMBODIMENTS

Figure 1:
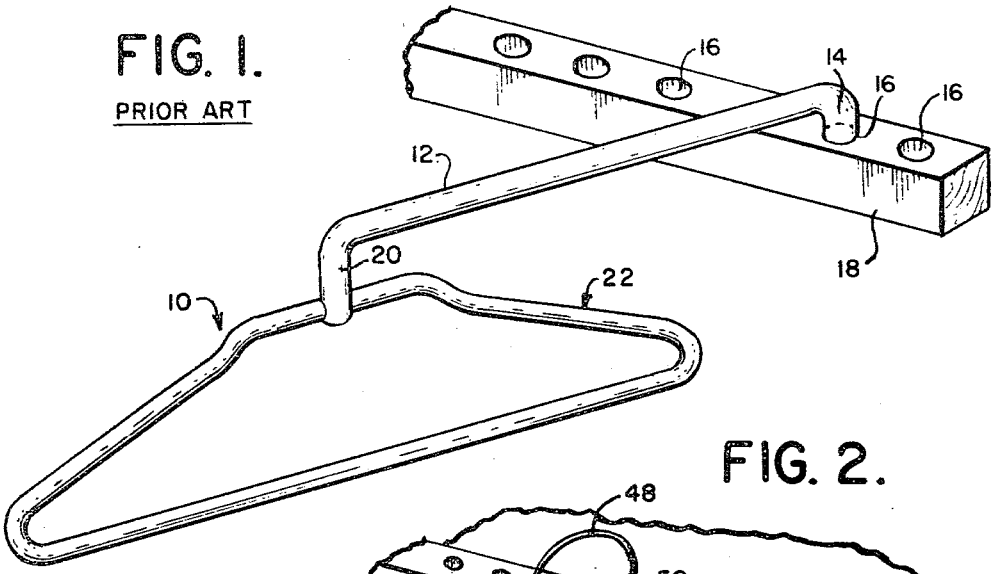
FIG. 1. PRIOR ART
FIG. 1 is a perspective view of a swingable hanger construction in accordance with the prior art mounted at one end thereof on a wall mount for pivotal movement thereabout.
Figure 2:
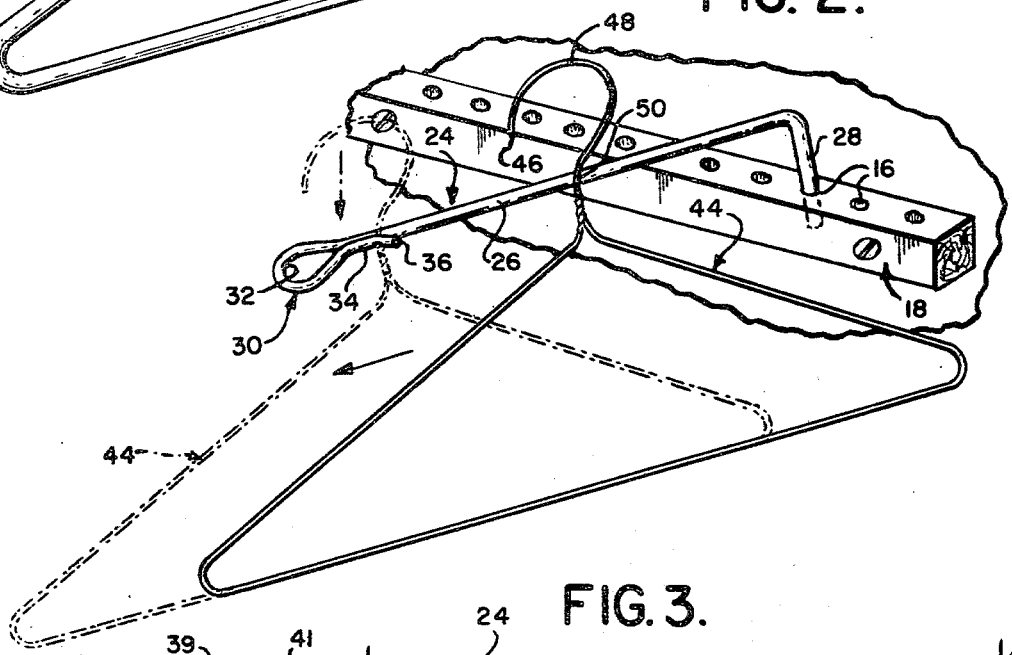
FIG. 2 is an elevational perspective view of a swingable hanger support member in accordance with one embodiment of the invention.

FIG. 1 illustrates a swingable hanger assembly 10 in accordance with the prior art. Assembly 10 comprises a laterally extending rod 12 terminating at one end thereof with a downwardly extending portion 14 adapted to be inserted into aperture 16 in a mount 18 conveniently secured to the inner wall of a closet. The other end of rod 12 terminates in a downwardly extending portion 20 to which there is permanently secured conventional hanger formation 22 adapted to support an article of wearing apparel such as a jacket, blouse, pants, skirt, etc. Such arrangement permits the entire assembly 10 to freely swing about the pivot defined by downward portion 14. In normal usage, each of apertures 16 supports a similar assembly 10 and such overall arrangement makes much more efficient utilization of limited closet space because apertures 16 can be closely spaced to each other and yet permit each hanger formation 22 to be easily accessible by freely swinging away from each other the assemblies to the left and those to the right of the particular assembly from which an article of wearing apparel is to be either removed or onto which such article is to be placed.

As heretofore described, the difficulty with prior art assembly 10 is that the hanger formation 22 is permanently affixed to the entire assembly so that the user is prevented from utilizing independent hangers for functional or aesthetic reasons.

In accordance with one embodiment of the invention, illustrated in FIGS. 2 to 6, there is provided a hanger support member 24 comprising a laterally extending straight rod portion 26 terminating at one end thereof into a downwardly extending portion 28 preferably forming an angle slightly greater than 90° with rod portion 26, which downwardly extending portion is adapted to be received into aperture 16 of wall mount 18. The opposite end of the rod 26 is bent back upon itself to define with rod 26 a formation 30 comprising closed loop 32, a flat portion 34 which engages rod 26, and a diverging portion 36. Such formation 30 thus defines a pair of V-shaped confronting openings 38 and 40, respectively, which are separated by juncture 42 between rod 26 and portion 34.

In order to suspend a conventional hanger 44 from hanger support member 24, the free end 46 of hook 48 is inserted downwardly into loop 32 causing spaced portions 39 and 41 of hook 48 to automatically be wedged into V-shaped openings 38 and 40 to suspend hanger 44 in a vertical plane which is substantially coplanar with the plane defined by rod 26 and end portion 28 thereof.

In many instances, the hanger support member is at an elevated location and above eye level whereby it may be difficult to easily insert free end 46 of the hanger hook into loop 32. In such event, the construction in accordance with the invention enables the hook to be easily guided into position wherein free end 46 of the hanger hook is immediately above loop 32 so that it can then be easily lowered therein for suspending the hanger onto support member 24. More specifically, as shown by the full lines in FIG. 2, the hanger is held against rod 26 intermediate its ends so that the neck 50 of the hanger is in engagement with the rod. Thereafter, the hanger is moved laterally while maintaining its engagement with rod 26 until the neck of the hanger abuts V-shaped aperture 40 as shown by the phantom lines in FIG. 2. In this position of the hanger, free end 46 of the hook is lowered, automatically inserting the same into the closed loop 32 to complete the securement of the hanger onto support member 24.

The hanger support member 24 may be made of conventional ¼" diameter wire stock which has been found quite satisfactory both from the standpoint of ease of shaping into the desired form and from the standpoint of having sufficient strength to support a hanger and the clothing carried thereby.

Figure 3:
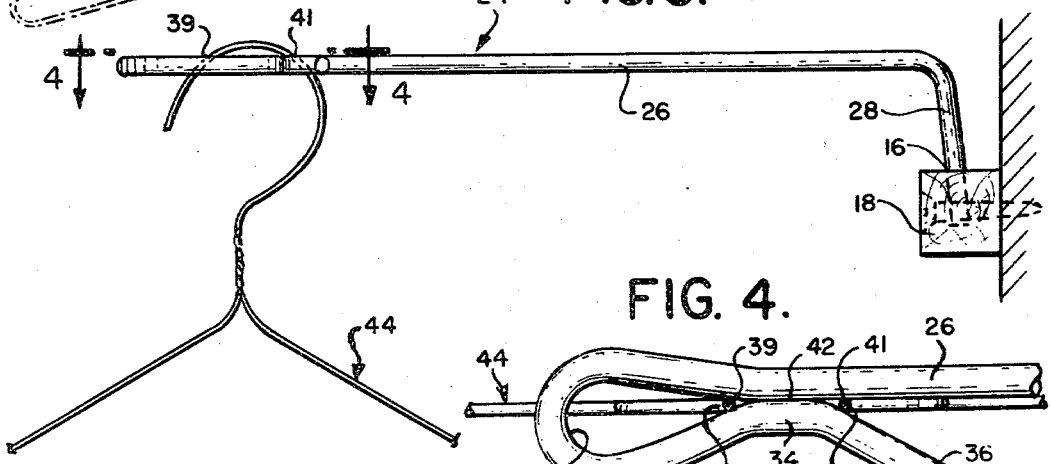
FIG. 3 is an elevational view of the swingable hanger support member of FIG. 2.
Figure 4:
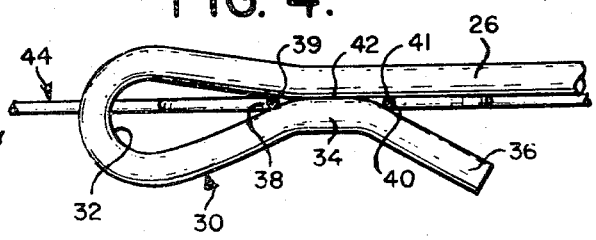
FIG. 4 is a view taken along line 4—4 of FIG. 3 on an enlarged scale.
Figure 5:
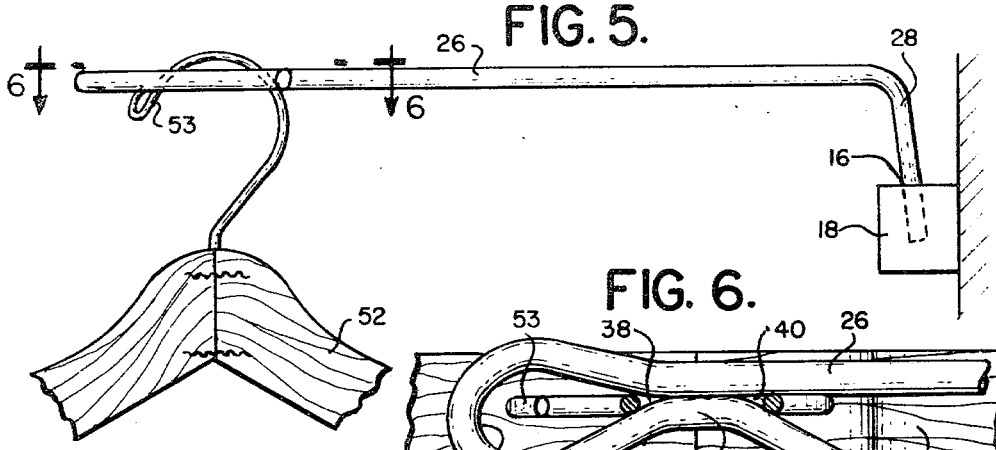
FIG. 5 is a view similar to FIG. 3 but showing a different form of hanger suspended therefrom.
Figure 6:
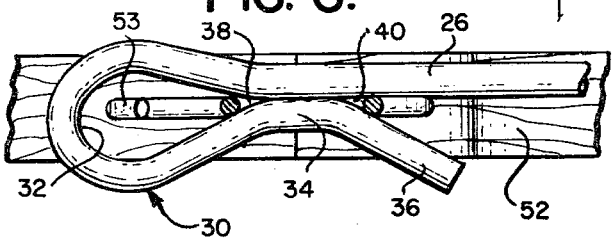
FIG. 6 is a view taken along line 6—6 of FIG. 5, on an enlarged scale.

FIGS. 5 and 6 illustrate a construction identical to that shown in FIGS. 3 and 4 with a conventional wooden hanger 52 having a slightly different hook 53, instead of the conventional wire hanger 44, being suspended therefrom, again in a vertical plane substantially coplanar with the plane defined by rod 26 and end portion 28 thereof.

Thus it is seen that the embodiment of FIGS. 2 through 6 provides a hanger support member to which may be easily and releasably secured any conventional hanger so that the latter can be mounted in laterally spaced relation from a wall mount with respect to which it is pivotable so as to realize all the advantages of a swingable hanger assembly.

It will also be noted that this embodiment is of extremely simple construction requiring only a single wire bent at one end to provide a pivot insertable into an aperture of a wall mount and bent upon itself at the other end thereof to define a formation from which a hanger can easily and automatically be suspended and wedged into a vertical plane substantially coplanar with the vertical plane defined by the laterally and downwardly extending portions of the support member.

Figure 7:
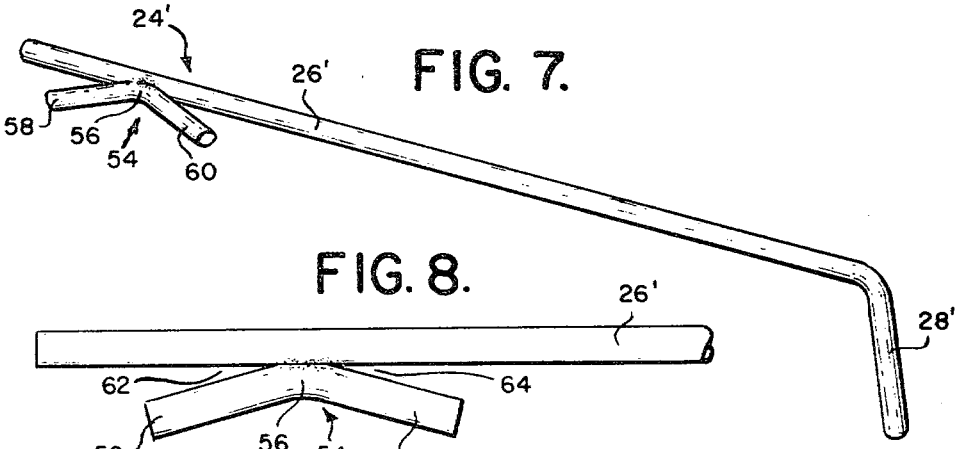
FIG. 7 is a perspective view of another embodiment of a swingable hanger support member in accordance with the invention.

FIG. 7 illustrates a hanger support member 24′ in accordance with another embodiment of the invention. Support member 24′ comprises a laterally extending straight rod portion 26′ terminating at one end thereof into a downwardly extending portion 28′ which functions in a manner identical to end portion 28 of the embodiment in FIG. 2.

The opposite end of rod 26′ is provided with separate formation 54 having a flat portion 56 welded onto rod 26′ and a pair of diverging side portions 58 and 60 whereby there are defined V-shaped apertures 62 and 64, respectively, separated by the welded juncture between rod 26′ and flat portion 56. It will be evident that support member 24′ functions precisely in the same manner as support member 24 of FIGS. 2 through 6, with V-shaped apertures 62 and 64 wedging spaced portions of the hanger hook to suspend the latter in the desired vertical plane. It should be noted that in accordance with this embodiment, the hanger may be suspended with the free end of the hook being wedged in either aperture 62 or 64 as compared to the embodiment of FIGS. 2 through 6 wherein the free end of the hook can only be inserted into the closed loop 32 of formation 30. In all other respects, the embodiment 24′ functions in precisely the same manner as embodiment 24.

Figure 9:
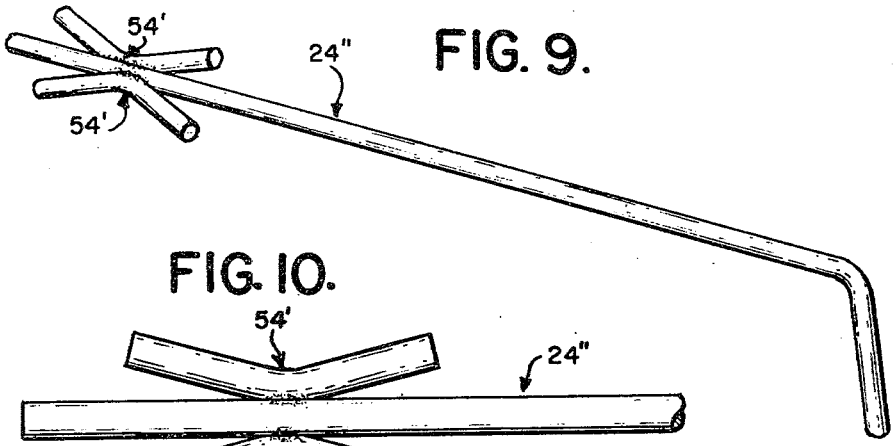
FIG. 9 is a perspective view of yet another embodiment of a swingable hanger support member in accordance with the invention.
Figure 10:
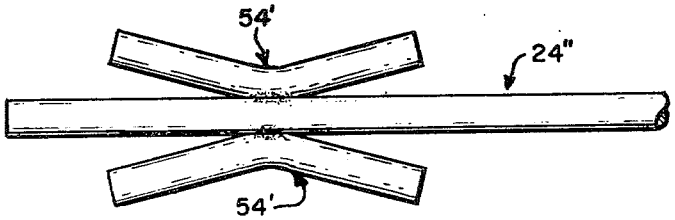
FIG. 10 is a top plan view of the outer end of the hanger support member of FIG. 9.
Figure 8:
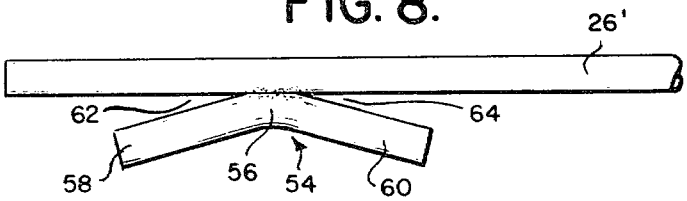
FIG. 8 is a top plan view of the outer end of the hanger support member of FIG. 7.

Referring now to FIGS. 9 and 10, there is shown hanger support member 24″ in accordance with yet another embodiment of the invention. Support member 24″ is in all respects identical with support member 24′ of FIGS. 7 and 8 except only that there are provided two formations 54′ rather than a single formation 54. Such arrangement enables a hanger to be supported at either side of the support member. Such embodiment further enables two hangers to be supported where such hangers are intended to carry relatively thin articles of wearing apparel such as blouses. Again, in all other respects, the embodiment in accordance with FIGS. 9 and 10 functions in precisely the same manner as the earlier described embodiments.

FIGS. 11 through 14 illustrate a hanger support member 24‴ in accordance with yet another embodiment of the invention. Support member 24‴ comprises a laterally extending straight rod portion 26‴ terminating at one end thereof into a downwardly extending portion 28‴ which functions in a manner identical to end portion 28 of the embodiment in FIG. 2.

The opposite end of rod 26‴ is provided with a separate formation 66 suitably secured adjacent its bottom end to rod 26‴ and extending from said bottom end upwardly and sidewardly from rod 26‴, as best shown in FIG. 12.

As best shown in FIGS. 13 and 14, such formation enables the suspension of the hanger hook between it and rod 26‴ wherein said hook is wedgingly supported in a vertical plane by engagement of spaced segments A and B thereof against rod 26‴ and engagement of uppermost segment C thereof against formation 66. This wedging action is caused, as best shown in FIG. 14, by formation 66 exerting a lateral force against segment C in the direction of arrow D and by rod 26‴ exerting a lateral force against spaced segments A and B in the direction of arrow E. Thus such three segment engagement of the hook by support member 24‴, in cooperation with the weight of the hanger, wedgingly supports said hanger in a vertical plane. It should be noted that in accordance with this embodiment a hanger may be suspended with the free end of the hook facing either inwardly, as shown, or outwardly.

Referring now to FIGS. 15 through 17, there is shown hanger support member 24⁗ in accordance with yet another embodiment of the invention. Support member 24⁗ is in all respects identical with support member 24‴ of FIGS. 11 through 14 except only that there are provided two formations 66′, on opposite sides of rod 26⁗, instead of only a single formation 66. As shown in the figures, however, both formations 66′ may be formed of a single member suitably bent into shape and secured at its mid-portion to rod 26⁗. Such arrangement enables a hanger to be supported at either side of the support member, or, if two hangers are intended to carry relatively thin articles of wearing apparel, then such arrangement enables the support of such two hangers simultaneously. It will be understood that the wedging action provided by the three segment engagement, as described in connection with the embodiment of FIGS. 11 through 14, is present in the embodiment of FIGS. 15 through 17 for wedgingly supporting the suspended hanger, on either or both sides of rod 26⁗, in a vertical plane.

It will be noted that the embodiment of FIGS. 11 through 14 as well as the embodiment of FIGS. 15 through 17 is capable of suspending a hanger in a vertical plane, with such three segments wedging action, regardless of the thickness of the hook of the hanger. More specifically, if the hook is of greater thickness, then the upper segment C will engage formation 66 at a higher point but nevertheless, in cooperation with segments A and B, will cause the necessary wedging action for maintaining the hanger in vertical disposition. Conversely, if the hook is of smaller thickness, the engagement of segment C with formation 66 will be at a lower point on such formation but again, in cooperation with the wedging action of segments A and B, will cause the hanger to be suspended in a vertical plane. Thus, regardless of the particular thickness of the hook of the hanger, the embodiments described in FIGS. 11 through 17 are self compensating to cause a three segment wedging action to compel the suspension of the hanger in the intended vertical plane.

While there is herein shown and described the preferred embodiments of the invention, it will be understood that the invention may be embodied otherwise than as herein specifically illustrated or described, and that in the illustrated embodiments certain changes in the details of construction and in the form and arrangement of parts may be made without departing from the underlying idea or principles of this invention within the scope of the appended claims.

Having thus described my invention, what I claim and desire to secure by Letters Patent is:

1. A longitudinal hanger support member adapted to have a conventional hanger releasably supported thereby adjacent one end thereof and mounted for pivotal movement about the other end thereof comprising (a) a laterally extending longitudinal member mounted for pivotal movement about one end thereof, (b) said longitudinal member being provided adjacent but slightly spaced from the other end thereof with a substantially planar formation which extends upwardly and sidewardly from at least one side thereof, (c) said hanger support member being adapted to receive the hook of said conventional hanger between said formation and said longitudinal member whereby three spaced segments of said hook are wedged so as to suspend said hanger in a vertical plane.

2. The hanger support member in accordance with claim 1, wherein the two outer segments of said hook are wedgingly engaged against said longitudinal member and the intermediate segment is wedgingly engaged against said formation.

3. The hanger support member in accordance with claim 1 or 2, wherein there is provided a formation at each of the opposite sides of said longitudinal member whereby the hanger can be selectively suspended from either or both of said sides.

4. The hanger support member in accordance with claim 3, wherein said formations are formed of a unitary member secured at its midpoint to the underside of said longitudinal member.

* * * * *